United States Patent [19]

Kühn et al.

[11] Patent Number: 4,550,577

[45] Date of Patent: Nov. 5, 1985

[54] KNITTING MACHINE WITH ROCKING KNOCK-OVER BITS, AND METHOD OF KNITTING THEREWITH

[75] Inventors: Falk Kühn, Kiebingen; Alfred Buck, Hailfingen, both of Fed. Rep. of Germany

[73] Assignee: Memminger GmbH, Freudenstadt, Fed. Rep. of Germany

[21] Appl. No.: 559,494

[22] Filed: Dec. 8, 1983

[30] Foreign Application Priority Data

Dec. 23, 1982 [DE] Fed. Rep. of Germany ..... 3247767

[51] Int. Cl.[4] ..... D04B 15/24; D04B 15/06

[52] U.S. Cl. ..... 66/104

[58] Field of Search ..... 66/90, 104, 106, 107, 66/108 R, 108 A

[56] References Cited

U.S. PATENT DOCUMENTS

| | | | |
|---|---|---|---|
| 504,967 | 9/1893 | Cook | 66/107 |
| 1,813,849 | 7/1931 | Guillemot | 66/107 |
| 2,101,005 | 11/1937 | Lawson | 66/108 R |
| 2,378,947 | 6/1945 | Page | 66/107 |
| 4,018,063 | 4/1977 | Buck | 66/104 X |

FOREIGN PATENT DOCUMENTS

| | | | |
|---|---|---|---|
| 2073262 | 10/1981 | United Kingdom | 66/90 |

*Primary Examiner*—Wm. Carter Reynolds

*Attorney, Agent, or Firm*—Frishauf, Holtz, Goodman & Woodward

[57] ABSTRACT

To insure gentle latch operation, and particularly gentle opening of the latch, the last-knitted loop (36) is constrained to move in the same direction as the needles (2) by controlling movement of sinkers (7) in the same direction as the needles, at a speed slower than needle speed during the raising phase of the needles (FIGS. 5, 6), so that initial movement of the latch occurs slowly and not abruptly to permit faster knitting speeds by reducing stresses on the latch. Conversely, during closing movement of the latch (FIGS. 9, 10), initially, the loop and the needle are lowered simultaneously, the lowering speed of the loop, controlled by the sinker (7) being slower than the lowering speed of the needle. Cast-off can be improved by rapidly controlling the loop by suitable sinker movement (FIGS. 11, 12). The projection distance of the needle can be decreased to at most that of the latch motion distance by constraining the loop, held on a sinker as well as on the shaft of the needle, to a position below the rest position of the sinkers by suitable construction of the sinker cam (15, 15*a*, 15*b*; FIG. 2).

20 Claims, 12 Drawing Figures

KNOCKOVER POSITION

TUCK POSITION

CLEARING POSITION

YARN INSERTION

CASTING OFF

KNITTING MACHINE WITH ROCKING KNOCK-OVER BITS, AND METHOD OF KNITTING THEREWITH

Reference to related application, the disclosure of which is hereby incorporated by reference, by the inventors hereof: U.S. Ser. No. 599,495, filed Dec. 16, 1982, KUHN et al Reference to further applications and patent: German Patent Disclosure Document DE-OS No. 31 08 041. German Patent Disclosure Document DE-OS No. 20 25 144. U.S. Pat. No. 2,090,500.

The present invention relates to knitting machines, and more particularly to knitting machines, and method of knitting, in which needles are controlled to move between knock-off and tuck position, and in which, additionally, hold-down and sinker jacks or bits are used, controlled to move by a sinker cam.

BACKGROUND

When manufacturing knit or Jersey knit goods on latch needle type knitting machines, for example circular knitting machines, the latches of the latch needles are forcibly opened, so that the last-formed stitches or loops slide along the shank of the needles from the needle hook. The last-formed stitches or loops thus effect the opening of the latches, thereafter sliding over the head of the latches onto the needle shank. Current high-performance knitting machines, for example, may have three to four feeds per nominal inch diameter. Such high density of knitting feeds requires cam races or cam tracks engaging the butts of the needles such that the raising cams have a comparatively steep needle projection angle and, thereafter, the lowering cams likewise have a steep angle. This rapid projection and retraction, respectively, of the needles results in very fast opening of the latches of the needles. Typically, the opening process is already terminated while the needle passes through one needle division or cut. In a circular knitting machine of 30" nominal diameter, and having a circumferential speed of, for example, 1.2 m/sec, the speed of movement of the latch of the latch needle may reach 30 m/sec. These high speeds of operation of the latch elements of the needles result in substantial engagement speeds or forces, and particularly in substantial speed at the tip of the latches against the shank, or the hook ends, respectively, which, of course, provide for high loading of the needles and especially of the latches. This substantial stress placed on the latches results in deformation and breaks of portions of the needle heads or the shank portion in the region of engagement of the latches when pivoting backwardly.

It has been proposed to improve the needles to be able to accept the high forces, and the high speeds which must be stopped practically instantaneously. Special high-speed needles were developed which, by special construction, provide for elastic damping of the latch, and specifically the impacts of the latch when it is completely opened and is flipped backwardly against the needle shaft. The inertia mass of the latch of the needle, decrease of the length of the latch from the pivot point thereof, and the like, also have been used in order to decrease the high dynamic loading on the needles. Yet, it has been found that the limit of operating speed which can be reached is determined by the maximum stresses which can be placed on the needles.

THE INVENTION

It is an object to increase the operating speed of knitting machines, and particularly of circular knitting machines, so that the manufacture of knit and Jersey knit goods can be improved and accelerated without placing additional stresses on the needles themselves.

Briefly, the invention is based on an analysis of the knitting steps or sequences themselves and permits increase in operating speed by so modifying the knitting process that the needles are subjected to lesser stress than heretofore. In accordance with a feature of the invention, the last-formed stitch or loop is moved along with the needle, during the projecting movement thereof, under controlled conditions and with a controlled speed which is less than the projecting or raising speed of the needle until the latch of the needle is engaged by this last-formed stitch or loop and can be opened thereby. To move the stitches along with movement of the needle, although at a lesser speed, a sinker cam is provided which has a cam race formed with a lesser raising angle than the cam race of the needle raising cam, and which extends over the portion of the raising path of the needle corresponding to the path necessary to open the latch of the respective needle. The relative speed between the sinker jacks and the needle can readily be controlled and provided by suitable selection of the cam angles, and thereby control opening of the latch of the needle at a rate which provides for gentle and smooth movement of the latch, thereby protecting the elements or zones of the needles against which the latch impinges as it opens.

Increase in operating speed of a knitting machine in the manufacture of knit goods thus can be obtained by not only attending to improvement of the needle as such, but, rather, improving the entire knitting method. By deliberately moving the last-formed stitch together with the needle during the opening phase of operation of the latch, relative speed between the stitch or loop and the still closed latch is decreased. Consequently, as the latch then opens, it will engage the needle shaft with lesser speed so that the opening process of the latch, and hence of the needle hook, is carried out gently, the latch itself being subjected to a substantially decreased acceleration at the initiation of the opening thereof. Although the latch now opens slower, the overall operating speed of the machine can be increased. The raising speed of the needles, and hence the operating speed of the knitting machine, can be increased to a substantial extent without, however, overloading the latches of the needles or the elements of the needles which provide for bearing of the latches and support of the latches before, during and after opening thereof.

The method, and apparatus, is particularly suitable for high feed number circular knitting machines in which the cam races of the raising cams have a steep raising angle. By suitable choice of the form of the last-formed stitch or loop which is still retained in the hook of the needle, it is possible to control the opening speed of the latch to such an extent that it is below the level which is acceptable for the particular type of needle. Practical experience has shown that it is possible to operate machines at high speed although the needles, themselves, are not specially designed high-speed needles, without overloading standard needles. High-speed needles used in machines in accordance with the invention, and carrying out the process, have a substantially increased lifetime and resistance to needle breakage than heretofore thought possible.

In accordance with a feature of the invention, the hold-down phase of the stitch or loop formation can be optimized by moving the last-formed stitch or loop, still hanging in the hook of the needle, in a direction opposite to the needle projecting direction. This movement, imparted to the stitches or loops, necessarily pulls the stitches or loops towards the end of the latch, and which then are constrained to move thereover. This has the advantage that no loops even in tightly woven fabrics remain on the opened latch, or, possibly, could be carried along by the needle in the next projecting movement, and thus are not knitted-off. If this would occur, namely a loop being carried along on top of the latch of the needle, defects in the fabric would result. The method and structure thus insures that every loop or stitch will be moved over the associated open needle latch, and must slide thereover, so that the tightness of the resulting fabric can be improved.

The loop, hanging in the hook of the needle, by being constrained to move with the needle, permits projecting the needle by a path length which is smaller than or equal to the length of the latch from the pivot point, the loop being held at a distance from the tip of the open latch only sufficient to provide a safety gap. This permits reducing the projection or raising path length of the needles with respect to prior art path lengths, since, as well known, prior art machines always require extension or projection or raising of the needles over a path length which is substantially longer than the length of the latch—measured from its pivot point—in order to insure that a subsequent stitch or loop will be properly formed.

Decreasing the needle projection or raising distance consequently permits increase of operating speed or, alternatively, the use of a larger number of knitting feeds in high-feed machines. By decreasing the projecting or raising distances of the needles in circular knitting machines, it it possible to retain previously provided raising and lowering angles of the raising cams and lowering cams of the cam race, which, with a lesser projection distance, results in a shorter length of each one of the knitting feeds.

The latches can be closed also more gently than heretofore possible upon retraction of the needles to lowered position by, in accordance with a feature of the present invention, moving the loop still hanging on the shaft in the same direction as the lowering movement of the needle, but with a lesser speed, at least for the distance until the previously formed loop or stitch has engaged the latch and, thereby, closes the latch.

DRAWINGS

Figure 4:
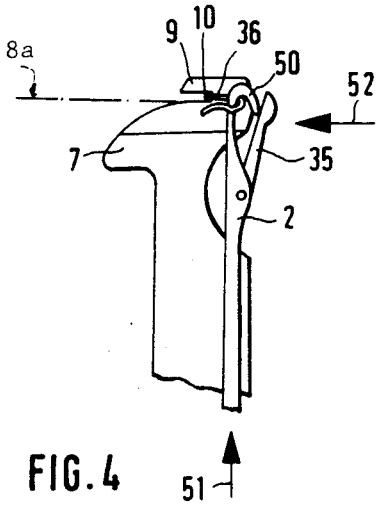
FIGS. 4 through 12 are sequential diagrams, in side view, showing the relative positions of the sinker heads and knitting needles and illustrating, sequentially, the formation of a knitting stitch or loop, in which the figures illustrate.
Figure 5:
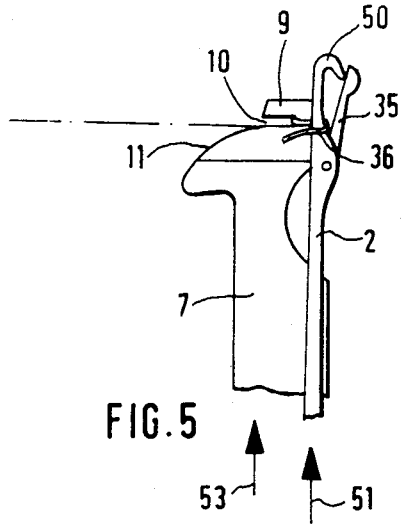
Figure 6:
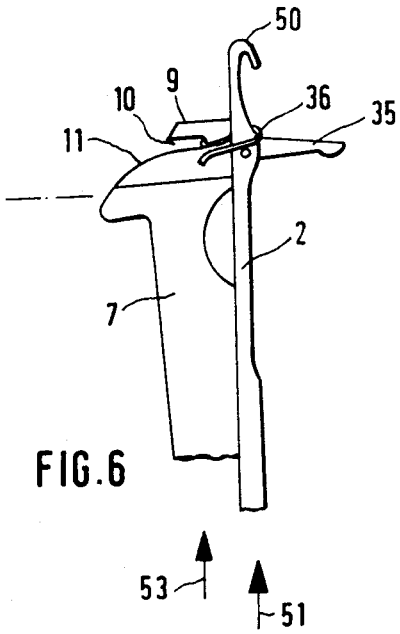
Figure 7:
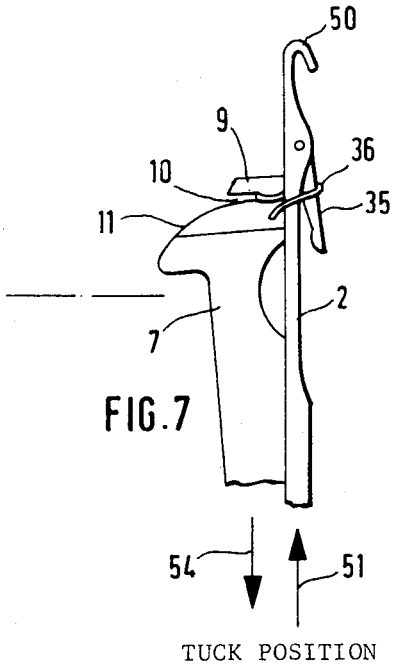
Figure 8:
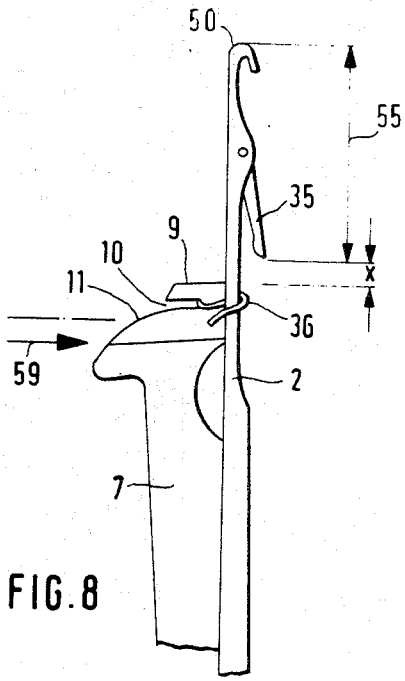
Figure 9:
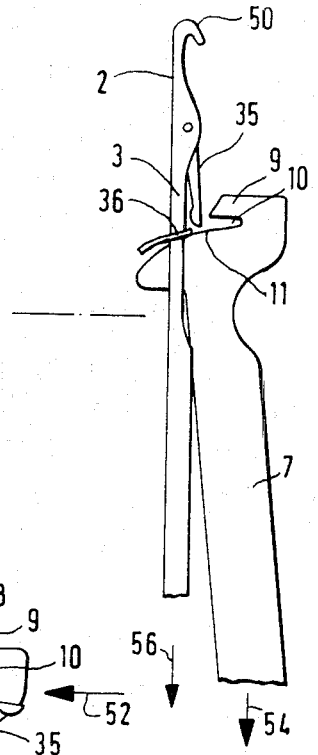
Figure 10:
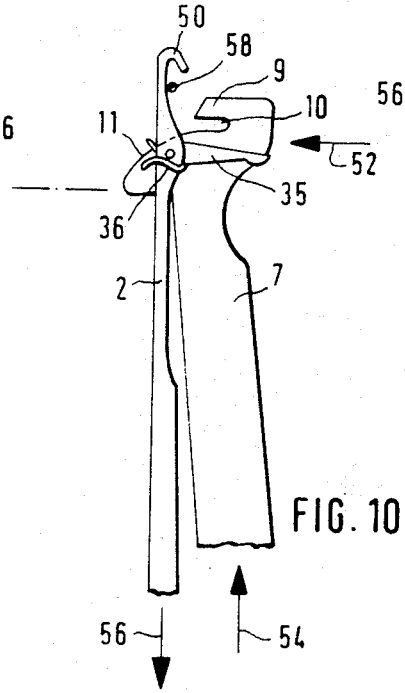
Figure 12:
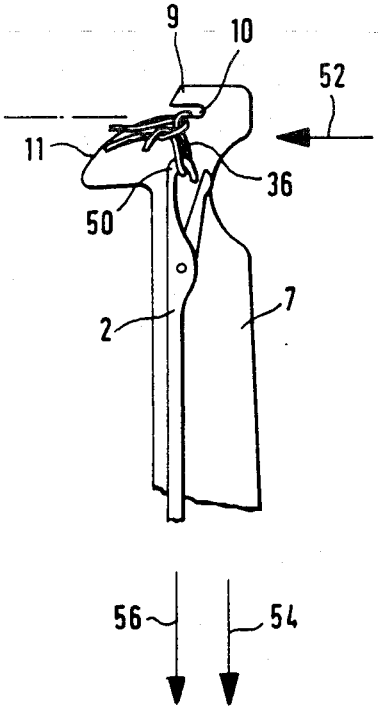

FIG. 4 the base or cast-off or knock-over position;

FIG. 5 the instant in which the previously formed stitch just begins to engage the needle latch;

FIG. 6 the instant of opening of the needle latch by the previously formed stitch;

FIG. 7 the tuck position with the latch fully opened;

FIG. 8 the position with fully raised or projected needle, or clearing position;

FIG. 9 the position just before closing of the latch, with incipient retraction of the needle;

FIG. 10 the position upon insertion of a new yarn and during closing of the latch;

FIG. 12 the position of the sinker and the needle upon loop or stitch formation, or casting-off position.

DETAILED DESCRIPTION

Figure 1:
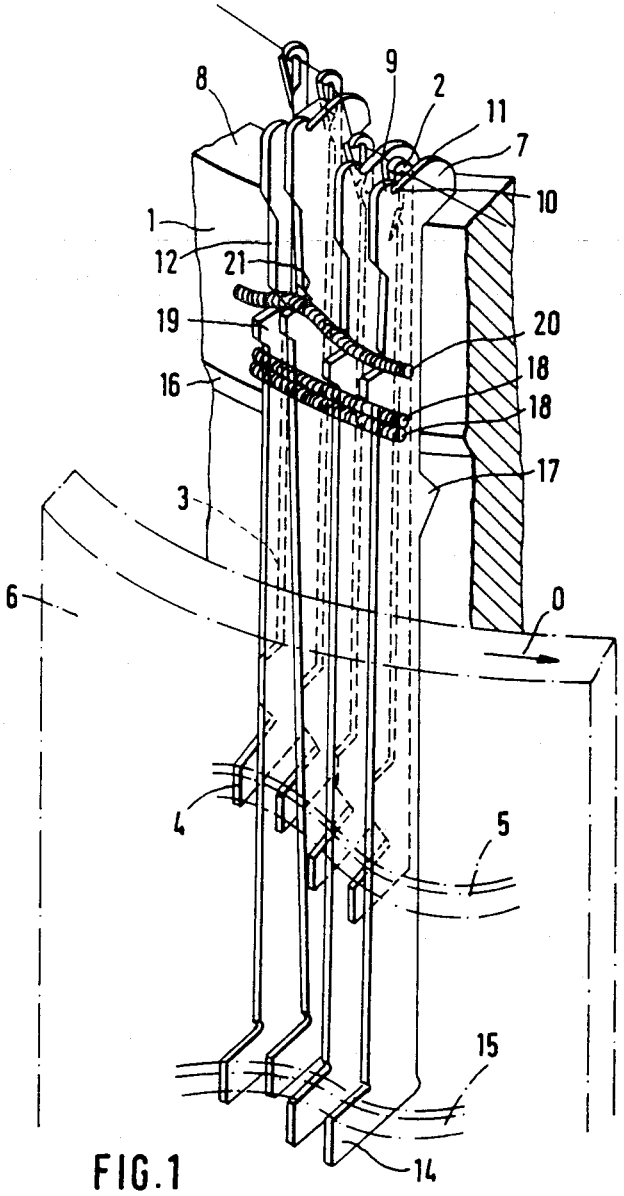
FIG. 1 is a schematic illustration of a portion of a circular knitting machine, showing a needle cylinder, a fragmentary perspective and part-phantom illustration.

Referring first to FIG. 1, which shows the arrangement in general, perspective view: A needle cylinder 1 of any standard and well known circular knitting machine has latch needles 2 located on its circumference, parallel with respect to each other and longitudinally slidably received in the cylinder. The latch needles 2 have butts 4 on the shafts 3 which engage a cam track or cam race 5 of the cylinder 1, the cam track 5 being formed within the cam box or cam shell 6. The cam box 6 can be formed, as well known, in a plurality of segmental parts, not specifically shown in the drawing, since any standard and suitable construction may be used. Relative rotation between the cam box 6 and the needle cylinder 1 is schematically indicated by the arrow 0, again in accordance with standard mechanism and practice. Due to the relative rotation, the cam track 5 will move the latch needles 2 in the respective required raising and lowering movement to the required position for stitch formation.

A sinker 7 is located between the needles 2, one sinker element 7 being positioned between two adjacent needles. The sinker 7 extends over the edge 8 of the cylinder 1. The sinkers 7 are best seen in the detailed illustrations FIGS. 4–12. The sinkers 7 each have a projecting sinker nose 9, a throat 10 and a loop or stitch forming edge 11.

The sinkers 7 (FIG. 1) all have sinker shafts 12 which are located immediately between the shafts 3 of adjacent needles 2 and are guided for longitudinal movement on the cylinder 1. The needle cylinder may be formed with guide ridges or guide strips, and intervening guide grooves, projecting radially and placed at suitable distances, depending on the cut of the machine, to provide axially extending, radially positioned engagement and slide surfaces for the shafts 3 of the needles 2 as well as for lateral guidance of the shafts 12 of the sinkers 7. The sinkers 7 may, for example, be located in grooves formed in the cylinder, with the needles being guided by the projecting shafts 12 of the sinkers. The cylinder may, also, be formed with projections to guide, positively, either the sinkers or the needles, with the unguided respective elements then being guided laterally by the adjacent needle or sinker, respectively. The cylinder, also, and as well known, can be formed with tricks or grooves retaining either the shafts 3 of the needles or the shafts 12 of the sinkers, or both, positioned adjacent each other.

Each one of the shafts 12 of the sinkers 7 are formed with a butt 14, preferably located at the end of the shaft 12 and engaged in a sinker cam track 15 and suitably controlled thereby so that the sinkers 7 will be controlled to execute raising and lowering movement, that is, to be projected and retracted, as will appear in detail below.

In accordance with a feature of the invention, a sinker cam track 16 is provided, located in the vicinity of the edge 8 of the needle cylinder 1. The sinker cam track 16 is formed by an externally tapered or extending inclined surface, for example cut on the cylinder wall itself. The cam track 16 is engaged by sinker camming projections 17, integral with the shaft 12 of the sinkers.

Operation of cam track 16 and sinker camming projections 17

As will be described in detail in connection with FIGS. 4–12, the cam track 16 causes the sinkers 7 to execute a tilting or pivoting movement radially outwardly with respect to the needles 2 upon being controlled to raise the position by the sinker cam track 15 in engagement with the butts 14, that is, upon respective raising and lowering movement of the sinkers. This radial movement, controlled by the sinker cam track 16, is in addition to the axial movement—with respect to the cylinder of the circular knitting machine.

Reliable engagement of the projections 17 with the cam track 16 is insured by radially inwardly directed force applied to the sinker shafts, for example, and preferably, by spring force acting on the sinker shafts. As shown, the radial force is generated by two circumferential endless springs 18, laterally engaged against projections 19 formed on the sinker shafts 12. The sinker shafts 12 extend radially beyond the needle shafts 3 by some short, predetermined distance to permit movement of the needle shafts 3 independently of engagement with springs 18. A separate spring 20 is provided, controlling the position of the shafts 3 of the needles and to prevent possible unintended movement of the heads or hook sections of the needles upon movement of the sinkers 7. The spring 20, located in the region between the sinker cam track 16 and the edge 8 of the cylinder provides radially inwardly directed force against the needles. The shafts 12 of the sinkers are formed with a recess or groove 21, open to the outside, to provide clearance for the spring 20 and to insure that the radial movability of the sinkers 7 is not interfered with or impaired by the presence of the spring 20.

Figure 2:
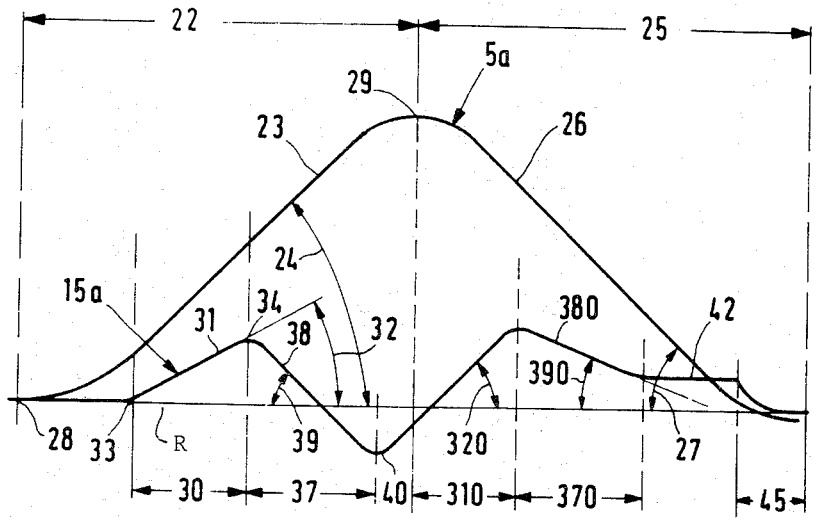
FIG. 2 is a developed diagram of the cam races for knitting needle butts and sinker butts.
Figure 3:
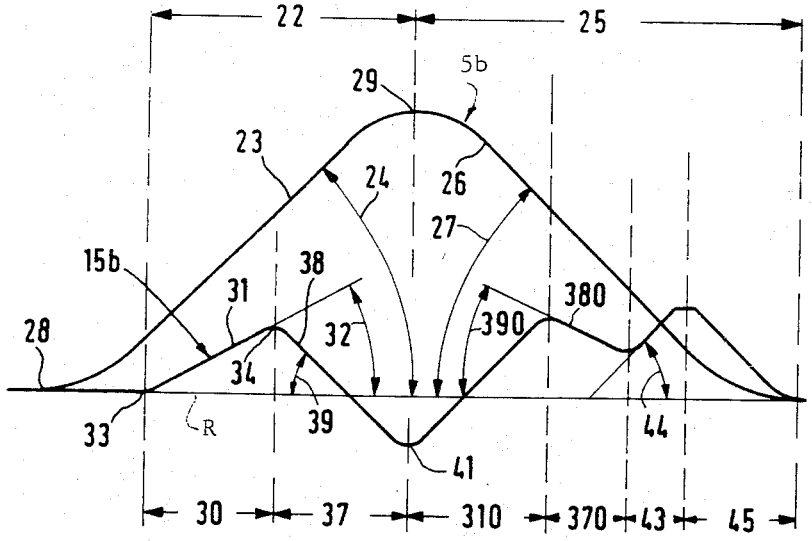
FIG. 3 is an illustration similar to FIG. 2 and showing another embodiment.

Control of operating movement of needles 2 and sinkers 7, with reference to FIGS. 2 and 3

The cam tracks or cam races 5 and 15, for the needle butts 4, and the sinkers butts 14, respectively, are shown in developed view as cam races **5*a* and 15*a* (FIG. 2) and 15*b* (FIG. 3**), respectively.

The needle cam track **5*a* has a raising portion 22 in which a raising section 23 is approximately straight, and forms an angle 24** with respect to a horizontal level or plane, transverse to the axis of rotation of the circular knitting machine.

The raising section 22 is joined by a lowering section 25 which, also, extends approximately straight throughout the section 26, forming an angle 27 with respect to the horizontal. The needles 2 start from a base position 28, represented in FIG. 4, which is the knock-over or cast-off position; the fully projected position—FIG.-8—corresponds to the peak of the cam track at 29, also corresponding to the thread receiving position.

The sinker cam tracks **15*a*, 15*b* have a raising section 30 which corresponds to an essentially straight cam track 31 forming an angle 32 with respect to the horizontal. As can be seen, angle 32 is less than the angle 24. The sinker cam raising portion 30 is located within the region of the needle raising portion 22 and so arranged that, starting from the position of the needles and sinkers of FIG. 4, the sinker cam track 15*a*, 15*b* causes the sinkers to move in the same direction as the needles, but at a speed which is less than the drive speed of the needles 2. This is due to the smaller angle 32 than the angle 24. The position of projection of the needles 2, starting from the base position 28 until the sinkers 7 are being projected, at position 33, corresponds roughly to the space for thread or yarn on the latch needles 2**, also known as the trapping clearance of the needles.

The extent of the raising portion 30 of the sinkers 7, looked at in circumferential—developed direction of the cam box 6—is less than the length of the associated raising portion 22 of the needles. The length of the portions 30 for the sinkers is so dimensioned that, after the sinkers have passed through the portion 31, the sinkers will be in the peak position 34, illustrated in FIG. 7. The latch 35 of the needle is fully open and the stitch or loop 36 formed in the previous knitting feed is still on the open latch 35. Reference to this position will be also made below.

A sinker lowering portion 37 follows the raising portion 30. The associated sinker cam track or race 38 forms an angle 39 with respect to the horizontal. The lowering portion 37 is so arranged that the lowering movement of the sinkers 7 is essentially terminated when the latch needles 2 have reached the clearing position at 29 (see FIG. 8). The sinker cam track **15*a*, 15*b* is so arranged that the sinkers 7 are drawn downwardly so far that—see also FIG. 8—the latch needles 2 in the fully extended or clearing position—hold the loops 36 with a reliable safety distance x beneath the tip of the open latch 35 of the latch needle, as will be explained in detail below with reference to FIG. 8. The point on the sinker cam 15*a* corresponding to FIG. 8 is shown at 40 in FIG. 2 and at 41 in FIG. 3, corresponding to point 29 of the needle cam curve. As can be seen, points 40 and 41 are below or beneath the horizontal base position corresponding to point 33. Consequently, the sinkers 7, at fully extended position of the needles 2**, are below the base position. This permits reducing the length of extension or raising of the needles, thus decreasing the needle path between fully raised and fully retracted or lowered position.

The sinker cam curves **15*a*, 15*b* have a second raising section 310 adjacent the previous lowering portion 37. The raising angle 320, only shown in FIG. 2 for clarity of the drawing, is so selected that the sinkers 7 are raised before the previously formed stitch or loop 36, still on the shaft 3 of the needle 2 (with fully opened latch 35) engages the lower portion of the latch—see FIG. 9, which is a position intermediate the clearing position and the yarn feeding position of the needles, and occurring during the lowering phase, cam portion 25**, of the needle.

In accordance with a feature of the invention, a second sinker lowering portion 370 follows subsequent to the raising portion 310. The sinker lowering portion 370 has a retraction or lowering angle 390, which is less than the lowering angle 27 of the needle lowering portion 25. The second sinker lowering portion 370, which is in the range of the needle lowering portion 25, is so arranged that the curved track 380 extends over the portion of the path of the latch needles 2 during the closing of the respective latches 35 of the needles 2 within the needle lowering portion. Consequently, a lowering movement is placed on the sinkers 7 upon closing of the latches 35 of the needles, in the same direction as the movement of the needles, but at a speed which is less than the retracting speed of the needles. This has the result that the needle latches 35 are controlled for gentle closing, rather than being snapped shut or jolted to flip over. This substantially decreases the loading on the latches 35 of the needles 2, and all complements with which the latch is in contact.

In some cases, it is not necessary to require gentle closing of the needle latches 35. In such arrangements, the second raising portion 310 and the second lowering portion 370 could be omitted, with the sinkers being merely raised to the rest position corresponding to position 33.

The difference between the tracks 15*a* (FIG. 2) and 15*b* (FIG. 3) is the terminal portion of the sinker cam track. In accordance with FIG. 2, a stitch forming or loop forming portion 42, which may include casting off of the formed loop, is provided in which the sinker remains at a partially projected position during further retraction of the needles 2 due to the curved portion 26 in the lowering portion 25 of the needle movement. The sinkers are then returned to base position.

The sinker cam curve 15*b* (FIG. 3) includes a further sinker raising portion 43, at an angle 44. The further sinker raising portion 43 is within the region of the needle lowering portion 25 and has this effect: The sinkers 7 are moved outwardly during the casting-off and knock-off movement of the latch needles 2. The projecting angle 44 of the sinker raising portion 43 can be so selected that the casting-off portion of the knitting loop formation is carried out gently and with less stress being applied to the thread or yarn. A further lowering portion 45 is then joined to the portion 42, 43, respectively, beyond the casting-off and knock-over portion in order to return the sinkers 7 to their base position corresponding to position 33 at the beginning of stitch formation.

Method of stitch or loop formation, and operation of the machine, with reference to FIGS. 4–12

The position of needle 2 in FIG. 4 corresponds to the position 28 (FIGS. 2, 3) of the needles, in which the needle cam track 5*a*, 5*b* has placed the needle into fully retracted position. The respective needle paths 5*a*, 5*b* are identical. The latch 35 of the needle 2 is closed. The last-formed loop or stitch 36 of the fabric is in the hook 50 of the needle. It is retained therein, as well known, by the nose 9 of the associated sinker 7. The sinker 7 is also in base position, see point 33, FIGS. 2, 3.

Starting from the position in FIG. 4, the needle 2 is raised in accordance with arrow 51 (FIG. 4). The sinker 7 remains in the base position into which it previously has been placed in the direction of arrow 52 (FIG. 4).

FIG. 5: The needle 2 has been raised by some distance which corresponds approximately to the trapping clearance of the needle. The loop or stitch 36, still retained in the throat of the needle, is at the position immediately in advance of contact with the latch 35, which still is closed.

The sinker 7 has reached the position 33 of the sinker cam track 15*a*, 15*b*, respectively, and is now moved in the same direction as the needle 2, that is, is being raised, as schematically indicated by arrow 53 (FIG. 5). The needle 52 continues in its raising direction in accordance with arrow 51.

FIG. 6: The latch needle 2 and the sinker 7 have continued their raising movement, see arrows 53, 51; referring to FIG. 2 or 3, and the sinker cam track 15*a*, 15*b*, the center or intermediate position of the track portion 31 of the sinker raising cam has been reached, at least approximately. Due to the substantially steeper or greater angle 24, corresponding to the needle raising cam angle with respect to the angle 32, corresponding to the sinker raising cam angle, the raising of the needle occurs with higher speed than the raising speed of the sinker 7. The previously closed latch 35 is thus opened by the loop or stitch 36 gently and slowly, since the loop 36 is still retained within the throat 10 beneath the sinker nose or hook 9 of the sinker 7.

FIG. 7: The needle is further protected, see arrow 51, until a point is reached in which the sinker butt 14 leaves the raising cam portion 30 and transfers to the sinker lowering cam portion 37. This reverses the direction of the sinker with respect to the movement of the needle, and the sinker is now being lowered, see arrow 54. The loop or stitch 36 of the previously formed stitch which hangs in the needle head is now positioned entirely on the needle which is in, or approaching the tuck position. In this point, the movement of the sinker 7 reverses. The sinker 7 is in a hold-down position, thus retaining the stitch or loop 36 in place.

FIG. 8: The latch needle has reached the top point 29 of the raising cam region 22 of the respective needle cam track 5*a*, 5*b*. The sinker 7, which is still in the hold-down position, has been lowered below the sinker base or rest position, see point 40, 41, of the sinker cam tracks 15*a*, 15*b* (FIGS. 2, 3), respectively. Due to this position of the sinker 7, loop 36 is constrained to remain in this lower position, so that the safety distance x to the tip of the opened latch 35 will be reliably maintained. The raising path or distance of the latch needle thus can be smaller or at least equal to the latch motion distance 55 (FIG. 8) of the latch 2, since the stitch 36 has been constrained to a lowered position due to the movement of the sinker 7 below the rest position.

Between the needle clearing position—FIG. 8—and the subsequent intermediate or yarn feeding position, FIG. 9—an additional motion occurs: The needle 2 is lowered by the lowering cam portion 310—see arrow 56 (FIG. 8), while the sinker 7 is raised by the second sinker raising cam portion 43, counter the movement of the latch needle 2, see arrow 53. The raising movement of the sinker is terminated before the sinker 7 has reached the position with respect to the needle 2 in which the last-formed loop or stitch 36 engages the fully opened latch 35 of the latch needle. The last-formed loop 36, as can be seen in FIG. 8, is still hanging in the throat 9 of the sinker 7, and held on the edge 11 of the sinker 7.

FIG. 9: The needle 2 continues its lowering path—see arrow 56. At the point in which the loop or stitch 36 is at a level, with respect to the needle 2, at which the tip of the latch 36 is just being contacted, which may be termed the beginning of the closing phase of the latch, the sinker 7 is controlled by the sinker cam track 16, upon engagement with the projection or cam element 17 on the sinker (FIG. 1) to assume a radially outward movement with respect to the cylinder 1, being moved in a position in which the nose 9 of the sinker releases or casts off the loop 36, as illustrated by the arrow 59 (FIG. 8) in which the initiation of the movement of the sinker 7 in radially outward direction is first shown.

The sinker 7 now is in a range of the second sinker lowering cam portion 370, thereby carrying out a movement which is in the same direction as that of the needle, see arrow 54 in FIG. 9. Additionally, the sinker 7 has been moved radially outwardly. The lowering angle 390 of the cam portion 380 of the second sinker lowering cam 370 is less than the lowering angle 27 of the needle lowering cam 25. Thus, the lowering movement of the sinker 7 occurs at a lower speed than that of the needle 2. This causes gentle closing of the needle latch 35.

FIG. 10: The needle latch 35 has moved through about half its closing position. A yarn having been fed by a yarn feeder, for example already at the position of FIG. 9, is shown at 58. FIG. 10 thus corresponds to the usual yarn feeding position.

Figure 11:
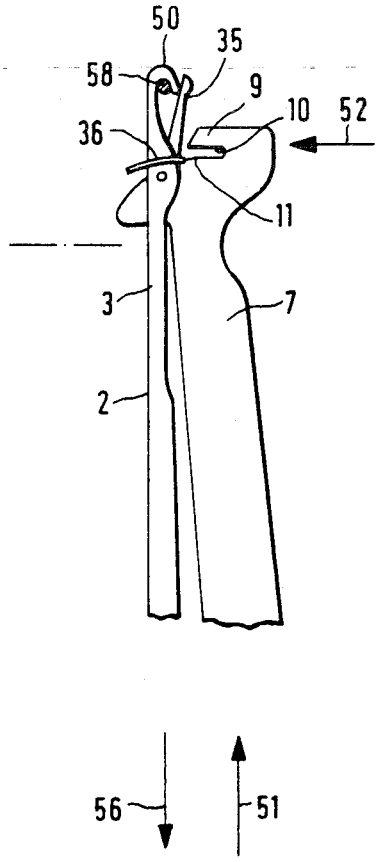

FIG. 11: The needle 2 continues its lowering movement, see arrow 56. The needle is approaching the casting-off position. The needle latch 35 is fully closed, and the new yarn or thread 58 is included in the trapping space within the hook of the needle.

In the embodiment of FIG. 3, in which the cam track 15*b* controls movement of the sinkers 7, the sinkers 7 are now again reversed and raised by the sinker raising cam portion 43, thus controlling the sinker to have a movement counter that of the needle, see arrow 51, FIG. 11. This embodiment, and this feature, improves the casting-off phase of stitch formation and places less stress on the thread or yarn.

FIG. 12: The needle 2 continues to be lowered and reaches the knock-over position. The sinker 7 is again reversed in direction, and the last sinker lowering cam portion 45 returns the sinker, in the same direction of movement as the needle, to its base or rest position, see arrow 56 for needle 2 and arrow 54 for sinker 7, respectively. The sinker 7 additionally carries out an inwardly directed radial movement, towards the cylinder 1, since the projection or nose or cam land 17 is released from the projection cam track 16 (FIG. 1). This places the sinker 7 in the position shown in FIG. 12, which is the knock-over position, the needle 2 reaching its base position. The position shown in FIG. 4, at the initiation of the knitting steps, will then be reached, just before the needle 2 is again raised—see arrow 51, FIG. 4. The next feed can then form another stitch or loop.

If the embodiment of FIG. 2, with a sinker cam track 15*a* is selected, the sinkers 7 remain stationary after the second sinker lowering cam has lowered the sinkers during the sinker lowering phase cam portion 370 on track 380. During track portion 380, the sinkers and the needles moved in the same direction, the sinkers, however, at substantially lower speed. The sinkers, then, during casting-off will remain stationary, as determined by the casting-off portion 42 of the cam track. Thereafter, sinkers 7 are lowered to their rest position by the further sinker lowering cam 45.

The apparatus and method have been described in connection with a circular knitting machine; fabric can be made, of course, in accordance with the method also and other types of knitting machines, for example flat-bed knitting machines equipped with latch needles, and control of the relative motion of the sinkers and needles can be, similarly, effected by suitable cam tracks on flat-bed machines.

FIGS. 2 and 3 illustrate only the cam track portions 5*a*, 5*b*, 15*a*, 15*b* for a single knitting feed. Of course, a machine will have a plurality of such feeds and the cam tracks will follow each other, starting from the base position.

The invention has been described with latch needles 2 and knock-over or sinker jacks 7 applied to the cylinder of a circular knitting machine. The arrangement may readily be changed by rotating the respective cam tracks by 90°, and providing the respective motions on the dial of a circular knitting machine.

The chain-dotted line 8*a*, only indicated in FIG. 4, but shown in FIGS. 4–12, corresponds to the theoretical edge 8 (FIG. 1) of the cylinder 1.

The movement of the sinkers 7 between the knock-over position (FIG. 4) and the tuck position (FIG. 7) in the same direction as the needles, but at a lesser speed, provides for gentle opening of the latch 35. Thereafter, see FIG. 7, the sinkers may move counter the direction of the needles. The cam track portion 38 is preferably so arranged that the sinkers 7 are retracted from projected or raised position before reversal of the needles at the clearing position (FIG. 8) occurs.

Due to the constrained movement of the last-formed stitches 36, still retained on the throats of the sinkers 7, it is possible to reduce the raising and lowering paths of the needles, so that projection by the needle raising cam can be at most equal to the latch motion distance, and may be less. This is made possible by withdrawing the sinkers 7, below the base or rest position, while still insuring the safety distance x from the tip of the opened latch 35 of the needle 2. This safety distance can be held smaller than that usually maintained in customary knitting machines since the loops are still constrained in their respective positions with respect to the needle by the sinkers 7.

The sinker raising cam portion 30, having cam tracks 31, thus insures gentle opening of the latch. Gentle closing of the latch is insured by the sinker lowering portions 370 and portions 42, 45 (FIG. 2) or 43, 45 (FIG. 3). The lowering angle 390 of the sinker lowering cam will be less than the lowering angle 27 of the needle lowering cam so that the difference in speed between the stitches on the needle, and needle movement will, again, cause gentle initiation of movement of the latch. The lowering movement of the sinker should extend at least approximately until the needles have reached their rest position, and may start beyond the yarn insertion position of the needle, see FIGS. 11 and 12.

The cam track shown in FIG. 3, in which the sinker are again raised, see track portion 43 is directed to a preferred embodiment since the counter-directed movement of needles and sinkers provides for gentle handling of thread or yarn and hence, with equal stresses being placed on the thread or yarn, permits further increase in operating speed of the machine. Prior withdrawal of the sinkers 7 below the base or rest position, as defined, for example, by the horizontal line R, FIGS. 2, 3, also permits increased machine speed since the projecting distance of the needles 2 can be decreased.

The respective angular relationship illustrated in FIGS. 2 and 3 are to be deemed illustrative; the angles can be made to be adjustable so that the respective speeds and distances can be set as required by specific machines, and specific yarn or thread characteristics, without requiring complete exchange of the cam box and the camming elements therein.

Various changes and modifications may be made, and any features described in connection with this invention may be used with any others, within the scope of the inventive concept.

The projecting distance of the sinkers 7 above the base line 8*a*, corresponding to the reference line R (FIGS. 2, 3) of the first raising motion, raising cam portions 30, can be made less than that of the second raising portion 310, so that the lands or cam projections 17 on the sinkers will not engage the cam race 16. Alternatively, projections 17 may extend in the direction opposite to that shown in FIG. 1, and be controlled by a cam track extending, in radially undulating form, in the cam box 6, with suitable relocation of the springs 18. Control of jack or shaft element motion can be carried out in accordance with known arrangements in standard knitting machines.

I claim:

1. Method of knitting yarn to form stitches or loops (36) on a knitting machine having a needle bed (1);

a plurality of elongated latch needles (2), each having a pivotable latch (35), the needles being longitudinally slidable on the needle bed;

including the step of moving the needles between a base or rest position (28; FIGS. 4, 12) and a clearing position (29; FIG. 8) through a tuck position (FIG. 7) in a raising or extending phase, and from the clearing position (29; FIG. 8) through a yarn insertion position (FIG. 10) to the base or rest position (28; FIGS. 4, 12) in a lowering or retracting phase, and comprising, in accordance with the invention, the step of positively moving (FIG. 6) the last-formed stitch or loop (36) on the needle during the raising phase in the direction of movement of the needle with a speed which is slower than the raising speed of the needle at least until (FIG. 6) the stitch or loop (36) has engaged the latch (35) of the needle and is opening the latch;

and positively moving the last-formed stitch or loop (36) in a direction counter the raising or extending direction of the needle upon opening of the latch on the needle (FIG. 7, FIG. 8).

2. Method according to claim 1, wherein the raising distance of the needle during the raising or extending phase thereof is equal to or smaller than the distance of latch motion of the needle;

and the step of moving the last-formed stitch or loop (36) in a direction counter the raising or extending movement of the needle comprises moving the stitch or loop for a distance which includes a safety distance (x; FIG. 8) from the tip of the latch (35) when the latch is in opened position.

3. Method according to claim 1, further comprising the step of positively moving (FIG. 9) the last-formed stitch or loop (36) during the lowering or retracting phase in a direction of movement of the needle with a speed which is slower than the speed of the needle at least until the last-formed stitch or loop (36) has engaged the latch and is closing the latch (35).

4. Method according to claim 3, including the step of positively moving the last-formed stitch or loop (36) in a direction counter the raising or extending direction of the needle upon opening of the latch on the needle (FIG. 7, FIG. 8).

5. Method according to claim 3, wherein the raising distance of the needle during the raising or extending phase thereof is equal to or smaller than the distance of latch motion of the needle;

and the step of moving the last-formed stitch or loop (36) in a direction counter the raising or extending movement of the needle comprises moving the stitch or loop for a distance which includes a safety distance (x; FIG. 8) from the tip of the latch (35) when the latch is in opened position.

6. Method according to claim 4, wherein the raising distance of the needle during the raising or extending phase thereof is equal to or smaller than the distance of latch motion of the needle;

and the step of moving the last-formed stitch or loop (36) in a direction counter the raising or extending movement of the needle comprises moving the stitch or loop for a distance which includes a safety distance (x; FIG. 8) from the tip of the latch (35) when the latch is in opened position.

7. Method of knitting yarn to form stitches or loops (36) on a knitting machine having a needle bed (1);

a plurality of elongated latch needles (2), each having a pivotable latch (35), the needles being longitudinally slidable on the needle bed;

including the step of moving the needles between a base or rest position (28; FIGS. 4, 12) and a clearing position (29; FIG. 8) through a tuck position (FIG. 7) in a raising or extending phase, and from the clearing position (29; FIG. 8) through a yarn insertion position (FIG. 10) to the base or rest position (28; FIGS. 4, 12) in a lowering or retracting phase, and comprising, in accordance with the invention, the step of positively moving (FIG. 9) the last-formed stitch or loop (36) during the lowering or retracting phase of the needle in the direction of movement of the needle with a speed which is slower than the speed of the needle at least until the stitch or loop (36) has engaged the latch (35) of the needle in latch closing direction and is commencing to close the latch.

8. Method according to claim 7, wherein the last-formed loop, consequent to closing of the latch of the needle, is moved in a direction counter the lowering or retracting movement of the needle (FIG. 11) to positively move the last-formed stitch over the closing latch (36) and guide the stitch towards the subsequent casting-off or knock-over position (FIG. 12) of the needle.

9. Method according to claim 7, wherein the raising distance of the needle during the raising of extending phase thereof is equal to or smaller than the distance of latch motion of the needle;

and including the step of moving the last-formed stitch or loop (36) in a direction counter the raising or extending movement of the needle, said step comprising comprises moving the stitch or loop for a distance which includes a safety distance (x; FIG. 8) from the tip of the latch (35) when the latch is in opened position;

and wherein the last-formed loop, consequent to closing of the latch of the needle, is moved in a direction counter the lowering or retracting movement of the needle (FIG. 11) to positively move the last-formed stitch over the closing latch (35) and guide the stitch towards the subsequent casting-off or knock-over position (FIG. 12) of the needle.

10. Knitting machine for knitting yarn to form stitches or loops (36) having a needle bed (1);

a cam structure (6);

a plurality of elongated latch needles (2), each having a pivotable latch (35), the needles being longitudinally slidable on the needle bed;

a plurality of elongated sinkers (7), the sinkers being, respectively, located between the needles and being longitudinally slidable on the needle bed, and movable towards and away from the needle bed;

the cam structure (6) having a needle cam track (5, 5*a*, 5*b*) including a raising portion (22, 23) and a lowering portion (25, 26) for controlling raising or extension and lowering or retraction of the needles during raising and lowering phases, respectively, and a sinker cam track (15, 15*a*, 15*b*) for controlling raising and lowering movement of the sinkers (7), wherein, in accordance with the invention, the sinker cam track (15*a*, 15*b*) includes a first raising portion (30) controlling raising of the sinkers (7) during the raising phase of the needles, said cam track being shaped to provide raising movement of the sinkers at a speed which is slower than the raising speed of the needles, said first raising portion (30) extending for a portion of the raising portion of the needle cam track only, and until the raising distance of the needles corresponds to the opening distance of the latch (35) of the needle in which the sinker carries at least part of the stitch or loop (36) also entrained on the needle, to positively move the last-formed stitch or loop (36) during the raising phase of the needle in the direction of movement of the needle with a speed which is slower than the speed of the needle, at least until the stitch or loop (36) has engaged the latch (35) of the needle, and is opening the latch (FIG. 6).

11. Machine according to claim 10, further including a first lowering cam track portion (37) adjacent the first sinker raising portion (30) to move the sinker, and the stitch thereon, in a direction counter the raising movement of the needle.

12. Machine according to claim 11, wherein the first sinker lowering cam track portion (37) adjacent the first raising portion (36) is positioned to control retraction of the sinkers from their maximum projected or raised position before the needles have reached their fully raised or extended clearing position.

13. Machine according to claim 12, wherein the raising portion (22, 23) of the needle cam track (5, 5*a*, 5*b*) raises the needles over a distance which is at most about equal to the latch motion distance (55) of the needle.

14. Machine according to claim 13, wherein the first lowering portion (37) of the sinker cam track (15, 15*a*, 15*b*) controls the sinkers to retract to a position in which the last-formed stitch or loop (36) retained on the needle and on the sinker has cleared the tip of the opened needle latch (35) by a predetermined safety distance (x; FIG. 8).

15. Machine according to claim 10, wherein the sinker cam track (15, 15*a*, 15*b*) includes a first lowering portion (37, 38) controlling the sinkers to be lowered or retracted a subsequent second raising or extending portion (310) and a further second sinker lowering portion (370), said second sinker lowering portion controlling the sinkers to lower or retract during the lowering or retracting phase of the needles (25, 26), said second lowering portion extending (FIG. 9) during the path of the loop (36) on the sinkers and on the needles until engagement of the loop on the needle with the then opened latch (35) to close the latch;

and wherein the sinker cam track controls lowering or retracting speed of the sinkers which is slower than the lowering or retracting speed of the needles, and includes a cam track portion which is shallower or of lesser inclination than the needle cam track portion controlling lowering or retracting of the needles.

16. Machine according to claim 14, wherein (FIG. 3) the sinker cam track (15*b*) includes a third sinker raising or extending portion (43) and a third sinker lowering portion (45), controlling movement of the sinker first, in a direction counter the lowering or retracting motion of the needles and, thereafter, a movement in the same direction as the lowering or retracting movement of the needles and at a higher speed than the lowering movement of the needles.

17. Machine according to claim 14, wherein the first lowering portion of the sinker cam track extends for a position below a base position (R) of the sinker cam track and defines a beginning raising position in advance of the subsequent raising position of the sinker.

18. Knitting machine for knitting yarn to form stitches or loops (36) having a needle bed (1);

a cam structure (6);

a plurality of elongated latch needles (2), each having a pivotable latch (35), the needles being longitudinally slidable on the needle bed;

a plurality of elongated sinkers (7), the sinkers being, respectively, located between the needles and being longitudinally slidable on the needle bed, and movable towards and away from the needle bed;

cam structure (6) having a needle cam track (5, 5*a*, 5*b*) including a raising portion (22, 23) and a lowering portion (25, 26) for controlling raising or extension and lowering or retraction of the needles during raising and lowering phases, respectively, and a sinker cam track (15, 15*a*, 15*b*) for controlling raising and lowering movement of the sinkers (7), wherein, in accordance with the invention, the sinker cam track (15*a*, 15*b*) includes a lowering portion (370, 380) controlling lowering of the sinkers (7) during the lowering or retracting phase of the needles and shaped to provide lowering movement of the sinkers at a speed which is slower than the lowering speed of the needles, said lowering portion extending for a portion of the lowering phase of the needles only and until the lowering distance of the needles corresponds to the sliding distance of the loop (36) on the needle and on the sinker until engagement of said loop with the latch (35) in a latch-closing direction, for positively moving (FIG. 9) the last-formed stitch or loop (36) during the lowering phase of the needle in the direction of movement of the needle with a speed which is slower than the speed of the needle until the stitch or loop has engaged the latch and, thereby, gently effects closing of the latch.

19. Machine according to claim 18, wherein the sinker cam track includes a prior lowering or retracting phase (37, 38) for retracting the sinker subsequent to a still prior raising phase, said prior lowering cam track portion controlling movement of the sinker to a position (41) below a rest or normal position (R, 33) of the sinkers.

20. Method of knitting yarn to form stitches or loops (36) on a knitting machine having a needle bed (1);

a plurality of elongated latch needles (2), each having a pivotable latch (35), the needles being longitudinally slidable on the needle bed;

including the step of moving the needles between a base or rest position (28; FIGS. 4, 12) and a clearing position (29, FIG. 8) through a tuck position (FIG. 7) in a raising or extending phase, and from the clearing position (29; FIG. 8) through a yarn insertion position (FIG. 10) to the base or rest position (28; FIGS. 4, 12) in a lowering or retracting phase, and comprising, in accordance with the invention, the step of positively moving (FIG. 6) the last-formed stitch or loop (36) on the needle during a portion of the raising phase in the direction of movement of the needle with a predetermined, controlled speed which is slower than the raising speed of the needle at least until (FIG. 6) the stitch or loop (36) has engaged the latch (35) of the needle and is opening the latch; and subsequently, and while said needle is completing its raising phase, positively moving said stitch or loop (36) in the opposite direction.

* * * * *

UNITED STATES PATENT AND TRADEMARK OFFICE

CERTIFICATE OF CORRECTION

PATENT NO. : 4,550,577

DATED : November 5, 1985

INVENTOR(S) : Falk KUHN et al

It is certified that error appears in the above-identified patent and that said Letters Patent is hereby corrected as shown below:

COLUMN 4, after line 11, insert the following paragraph:

--Fig. 11 an intermediate position between yarn insertion and knock over;--.

Signed and Sealed this

*Eighth* Day of *April 1986*

[SEAL]

*Attest:*

DONALD J. QUIGG

*Attesting Officer*

*Commissioner of Patents and Trademarks*